US012693031B2

(12) United States Patent
Hwang et al.

(10) Patent No.: US 12,693,031 B2
(45) Date of Patent: Jul. 28, 2026

(54) AIR CONDITIONER AND CONTROL METHOD THEREOF

(71) Applicant: SAMSUNG ELECTRONICS CO., LTD., Suwon-si (KR)

(72) Inventors: Jun Hwang, Suwon-si (KR); Sukho Kang, Suwon-si (KR); Hyungjin Kwon, Suwon-si (KR); Daehui Kim, Suwon-si (KR); Jongwoon Kim, Suwon-si (KR); Taewoo Kim, Suwon-si (KR); Seungjun Park, Suwon-si (KR); Jungyong Sung, Suwon-si (KR); Sungjin Lim, Suwon-si (KR); Hyeongkyu Cho, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 311 days.

(21) Appl. No.: 18/119,408

(22) Filed: Mar. 9, 2023

(65) Prior Publication Data

US 2023/0204230 A1 Jun. 29, 2023

Related U.S. Application Data

(63) Continuation of application No. PCT/KR2022/016731, filed on Oct. 28, 2022.

(30) Foreign Application Priority Data

Dec. 7, 2021 (KR) ..... 10-2021-0174131

(51) Int. Cl.
*F24F 11/74* (2018.01)
*F24F 1/022* (2019.01)
(Continued)

(52) U.S. Cl.
CPC ..... *F24F 1/029* (2019.02); *F24F 1/022* (2013.01); *F24F 1/0284* (2019.02); *F24F 1/032* (2019.02);
(Continued)

(58) Field of Classification Search
CPC .. F24F 1/029; F24F 11/74; F24F 11/79; F24F 1/0358
See application file for complete search history.

(56) References Cited

U.S. PATENT DOCUMENTS

2017/0023264 A1* 1/2017 Ha ..... F24F 11/46
2020/0193982 A1* 6/2020 Kim ..... G10L 15/30
(Continued)

FOREIGN PATENT DOCUMENTS

CN 106765876 A 5/2017
CN 110848880 A * 2/2020 ..... F24F 1/0063
(Continued)

OTHER PUBLICATIONS

Akitoshi, Air Conditioner, 2018, Full Document (Year: 2018).*
(Continued)

*Primary Examiner* — Nael N Babaa
(74) *Attorney, Agent, or Firm* — STAAS & HALSEY LLP

(57) ABSTRACT

An air conditioner includes a cabinet including a front opening provided at a front surface thereof and a rear opening provided at a rear surface thereof; a heat exchanger provided inside the cabinet; a plurality of fans provided inside the cabinet and configured to allow air to pass through the heat exchanger; and a processor configured to control the plurality of fans so that in a cooling operation mode and a dehumidification operation mode, the plurality of fans are rotated in one direction so that the air is sucked through the rear opening, passes through the heat exchanger, and then is
(Continued)

discharged through the front opening, and in an automatic cleaning operation mode, the plurality of fans are rotated in an opposite direction so that the air is sucked through the front opening, passes through the heat exchanger, and then is discharged through the rear opening.

13 Claims, 14 Drawing Sheets

(51) Int. Cl.

| | |
|---|---|
| ***F24F 1/0284*** | (2019.01) |
| ***F24F 1/029*** | (2019.01) |
| ***F24F 1/032*** | (2019.01) |
| ***F24F 1/0358*** | (2019.01) |
| ***F24F 11/63*** | (2018.01) |
| ***F24F 11/79*** | (2018.01) |
| *F24F 110/20* | (2018.01) |

(52) U.S. Cl.
CPC ..... *F24F 1/0358* (2019.02); *F24F 11/63* (2018.01); *F24F 11/74* (2018.01); *F24F 11/79* (2018.01); *F24F 2110/20* (2018.01); *F24F 2221/22* (2013.01)

(56) References Cited

U.S. PATENT DOCUMENTS

| | | | |
|---|---|---|---|
| 2021/0332828 | A1 | 10/2021 | Cai et al. |
| 2021/0341169 | A1 | 11/2021 | Oh et al. |

FOREIGN PATENT DOCUMENTS

| | | | | | |
|---|---|---|---|---|---|
| CN | 110848920 | A | | 2/2020 | |
| CN | 110454914 | A | | 4/2021 | |
| CN | 113587246 | A | | 11/2021 | |
| EP | 1 826 501 | B1 | | 12/2017 | |
| JP | 2007-155270 | A | | 6/2007 | |
| JP | 4277166 | B2 | | 6/2009 | |
| JP | 2017-203588 | A | | 11/2017 | |
| JP | 6914297 | B2 | | 8/2021 | |
| KR | 10-2005-0057905 | A | | 6/2005 | |
| KR | 10-2008-0071720 | | | 8/2008 | |
| KR | 10-1100474 | B1 | | 12/2011 | |
| KR | 10-1320776 | B1 | | 10/2013 | |
| KR | 10-2018-0104206 | | | 9/2018 | |
| KR | 20200002749 | A | * | 12/2019 | |
| KR | 10-2020-0088609 | A | | 7/2020 | |
| WO | WO-2019116602 | A1 | * | 6/2019 | ..... B08B 5/02 |
| WO | WO-2022211372 | A1 | * | 10/2022 | ..... F04D 29/447 |

OTHER PUBLICATIONS

Gi, Indoor unit of air conditioner and controlling method for air conditioner, 2021, Full Document (Year: 2021).*
Song, Air Conditioner, 2020, Full Document (Year: 2019).*
FOR1, Air conditioner and self-cleaning control method and device thereof, 2019, Full Document (Year: 2019).*
International Search Report issued in International Application No. PCT/KR2022/016731 dated Feb. 17, 2023.
Written Opinion issued in International Application No. PCT/KR2022/016731 dated Feb. 17, 2023.
Extended European Search Report issued Oct. 21, 2024 for European Patent Application No. 22904461.5.
Examination Report dated May 19, 2026 issued by the European Patent Office for European Patent Application No. 22904461.5.
Korean Office Action dated Jun. 1, 2026 issued by the Korean Patent Office for Korean Patent Application No. 10-2021-0174131.

* cited by examiner

AIR CONDITIONER AND CONTROL METHOD THEREOF

CROSS-REFERENCE TO RELATED APPLICATION(S)

This application is a continuation application, under 35 U.S.C. § 111(a), of International Application No. PCT/KR2022/016731, filed on Oct. 28, 2022, which claims priority to Korean Patent Application No. 10-2021-0174131, filed on Dec. 7, 2021 in Korean Intellectual Property Office, the disclosures of which are incorporated by reference herein in their entirety.

1. FIELD

The disclosure relates to an air conditioner, and more particularly, to an air conditioner having an automatic cleaning function and a control method thereof.

2. DESCRIPTION OF RELATED ART

An air conditioner is a device that cools or heats air using a refrigeration cycle, and discharges the cooled or heated air to control the temperature of the room.

In general, an air conditioner may include an outdoor unit configured to exchange heat with outside air and an indoor unit configured to exchange heat with indoor air.

The indoor unit may include an inlet for sucking the indoor air, a heat exchanger for exchanging heat with the sucking air, a fan for circulating the indoor air, and an outlet for discharging the heat-exchanged air.

Accordingly, the indoor unit may exchange heat with the air sucked in by the fan using the heat exchanger and discharge the heat-exchanged air into the room.

The air conditioner performs an automatic cleaning operation after the cooling operation is completed to remove moisture condensed on the heat exchanger of the indoor unit during the cooling operation. During the automatic cleaning operation, the air conditioner stops the circulation of the refrigerant and rotates a fan disposed in the indoor unit to evaporate moisture condensed on the surface of the heat exchanger, thereby drying the inside of the indoor unit.

Drying the inside of the indoor unit is positive in terms of inhibiting the growth of mold and other microorganisms. However, an unpleasant odor may spread to the front of the air conditioner as odor-causing substances are released together with the air during the drying operation.

When an unpleasant odor is emitted during the automatic cleaning operation, the user may terminate the drying of the air conditioner without completing the drying operation. In this case, as microorganisms grow due to the moisture remaining inside the air conditioner, a vicious cycle may continue in which an unpleasant odor worsens whenever the automatic cleaning operation of the air conditioner is performed.

SUMMARY

According to an aspect of the disclosure, an air conditioner may include a cabinet including a front opening formed at a front surface of the cabinet and a rear opening formed at a rear surface of the cabinet; a heat exchanger inside the cabinet; a plurality of fans inside the cabinet and configured to guide air to pass through the heat exchanger; and a processor configured to control the plurality of fans so that during a cooling operation mode and a dehumidification operation mode, the plurality of fans are rotated in a first direction so that air is suctioned through the rear opening of the cabinet, passes through the heat exchanger, and is discharged through the front opening to an exterior of the cabinet, and in an automatic cleaning operation mode, the plurality of fans are rotated in a second direction, opposite to the first direction, so that air is suctioned through the front opening of the cabinet, passes through the heat exchanger, and is discharged through the rear opening to the exterior of the cabinet.

The plurality of fans are positioned along a vertical axis inside the cabinet.

The plurality of fans are positioned in between the front opening and the heat exchanger.

The heat exchanger has an area corresponding to the plurality of fans.

During the cooling operation mode, the processor may control a rotation speed of a fan located at a top of the plurality of fans to be the fastest, and control rotation speeds of the remaining plurality of fans located thereunder to be sequentially slowed.

The processor may rotate the fan located at the top of the plurality of fans at a maximum rotation speed during the cooling operation mode.

In the automatic cleaning operation mode, the processor may control a rotation speed of a fan located at a bottom of the plurality of fans to be the fastest, and control rotation speeds of the remaining plurality of fans located thereover to be sequentially slowed.

The processor may rotate the fan located at the bottom of the plurality of fans at a maximum rotation speed during the automatic cleaning operation mode.

The front opening of the cabinet may include a plurality of micro holes.

The air conditioner may include a humidity sensor in the cabinet and configured to transmit humidity information of the air to the processor, wherein the processor may be configured to adjust an operating time of the plurality of fans based on the humidity information transmitted from the humidity sensor when performing the automatic cleaning operation.

The automatic cleaning operation mode may include an automatic mode, a rapid mode, and a low noise mode.

According to another aspect of the disclosure, a control method of an air conditioner may include operating a compressor so that refrigerant flows through an inside of a heat exchanger; rotating a plurality of fans in a first direction while the compressor is in operation, so that indoor air is suctioned through a rear opening of a cabinet, passes through the heat exchanger, and is discharged through a front opening of the cabinet to an exterior of the cabinet; stopping the compressor and the plurality of fans; and rotating the plurality of fans in a second direction, opposite to the first direction, to perform an automatic cleaning operation in which the indoor air is suctioned through the front opening of the cabinet, passes through the heat exchanger, and is discharged through the rear opening of the cabinet to an exterior of the cabinet.

During the rotation of the plurality of fans in the second direction to perform the automatic cleaning operation, a rotation speed of a fan located at a bottom of the plurality of fans may be the fastest, and rotation speeds of the remaining plurality of fans located thereover may be sequentially slowed.

During rotation of the plurality of fans in the second direction to perform the automatic cleaning operation, the fan located at the bottom of the plurality of fans may be rotated at a maximum rotation speed.

During rotation of the plurality of fans in the second direction to perform the automatic cleaning operation may include adjusting an operating time of the plurality of fans based on a humidity of the indoor air.

BRIEF DESCRIPTION OF THE DRAWINGS

The above and other aspects, features, and advantages of certain embodiments of the disclosure will be more apparent from the following description taken in conjunction with the accompanying drawings, in which.

DETAILED DESCRIPTION

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

The terms 'first', 'second', etc. may be used to describe diverse components, but the components are not limited by the terms. The terms may only be used to distinguish one component from the others. For example, without departing from the scope of the disclosure, a first component may be referred to as a second component, and similarly, a second component may also be referred to as a first component.

The terms used in embodiments of the disclosure may be construed as commonly known to those skilled in the art unless otherwise defined.

Further, the terms 'leading end', 'rear end', 'upper side', 'lower side', 'top end', 'bottom end', etc. used in the disclosure are defined with reference to the drawings. However, the shape and position of each component are not limited by the terms.

Hereinafter, non-limiting example embodiments of an air conditioner according to the disclosure will be described with reference to the accompanying drawings.

The disclosure has been developed in order to overcome the above drawbacks and other problems associated with the conventional arrangement. An aspect of the disclosure is to provide an air conditioner in which wind containing odor is not discharged toward a user during an automatic cleaning operation for drying the inside of the air conditioner and a control method thereof.

According to the air conditioner having the structure as described above and the control method of the air conditioner according to an embodiment of the disclosure, wind containing smell is blown to the rear of the air conditioner during an automatic cleaning operation for drying the inside of the air conditioner. Therefore, air containing an unpleasant odor is not discharged toward the user.

Figure 1:
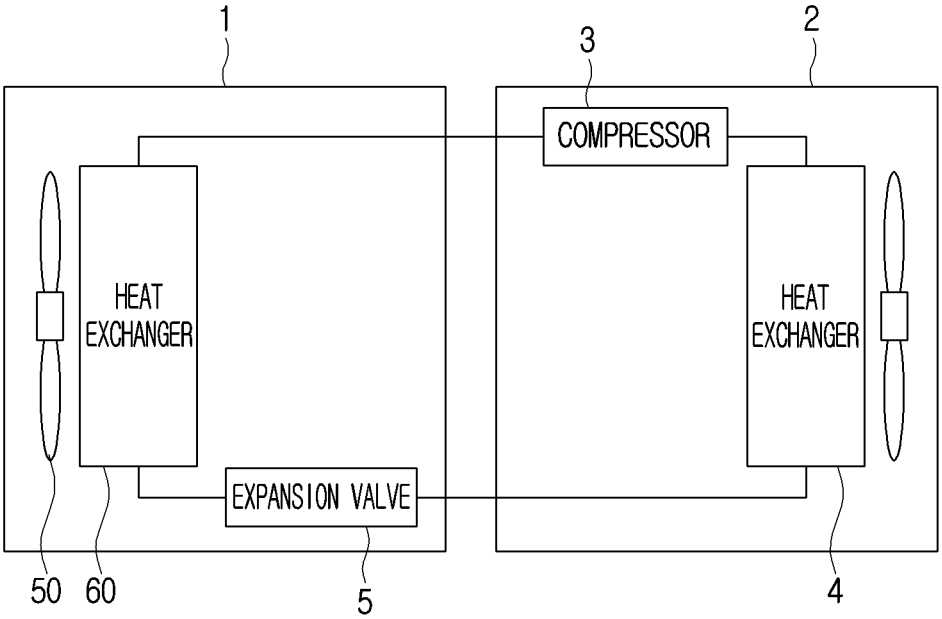
FIG. 1 is a view illustrating a refrigerant circuit of an air conditioning system according to an embodiment.

FIG. 1 is a view illustrating a refrigerant circuit of an air conditioning system according to an embodiment.

Referring to FIG. 1, an air conditioning system may include an indoor unit 1 and an outdoor unit 2.

The indoor unit 1 may be positioned in a room in which air conditioning is to be performed. For example, the indoor unit 1 may be disposed in the room of a house or an office.

The outdoor unit 2 may be disposed outdoors where air conditioning is not performed.

The air conditioning system includes a refrigerant circuit that circuits refrigerant between indoors and outdoors. The refrigerant circulates between indoors and outdoors along the refrigerant circuit, and may absorb or release heat during a change of state (e.g., change of state from gas to liquid, change of state from liquid to gas).

In order to induce a change in the state of the refrigerant, the refrigerant circuit may include a compressor 3, an outdoor heat exchanger 4, an expansion valve 5, and an indoor heat exchanger 60.

The compressor 3 is configured to compress gaseous refrigerant into a high-temperature and high-pressure gaseous refrigerant. The high-temperature and high-pressure gaseous refrigerant discharged from the compressor 3 flows into the outdoor heat exchanger 4.

In the outdoor heat exchanger 4, the high-temperature and high-pressure gaseous refrigerant is changed to a liquid refrigerant by the outdoor air, and heat is emitted. The liquid refrigerant discharged from the outdoor heat exchanger 4 flows into the expansion valve 5.

The expansion valve 5 lowers the pressure and temperature of the liquid refrigerant to make it a low-temperature and low-pressure liquid refrigerant. The low-temperature and low-pressure liquid refrigerant discharged from the expansion valve 5 flows into the indoor heat exchanger 60.

In the indoor heat exchanger 60, the low-temperature and low-pressure liquid refrigerant absorbs heat from the surrounding hot air so as to evaporate into a gaseous state. The gaseous refrigerant discharged from the indoor heat exchanger 60 flows into the compressor 3, and then circulates along the refrigerant circuit again.

As described above, the refrigerant may emit heat in the outdoor heat exchanger 4 and absorbs heat in the indoor heat exchanger 60. The indoor heat exchanger 60 may be disposed in the indoor unit 1 together with the expansion valve 5, and the outdoor heat exchanger 4 may be disposed in the outdoor heat exchanger 4 together with the compressor 3. Accordingly, the indoor heat exchanger 60 may cool the indoor air.

In the following description, for convenience of explanation, the indoor unit 1 is referred to as an air conditioner, and the indoor heat exchanger 60 is referred to as a heat exchanger.

Figure 2:
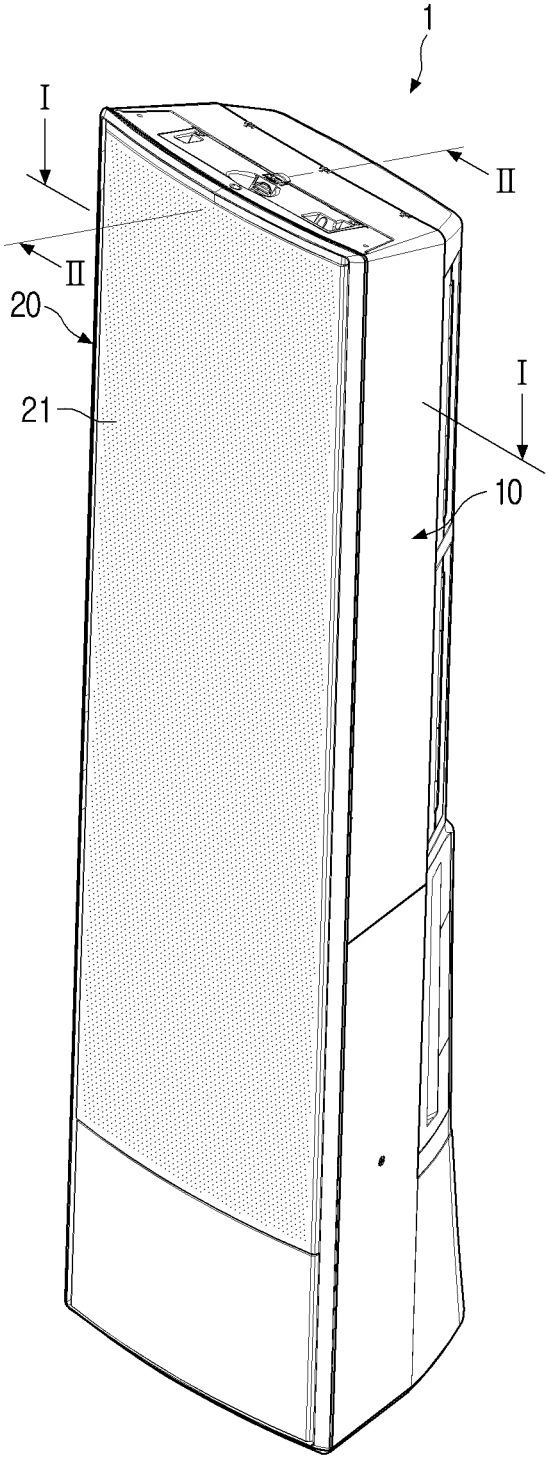
FIG. 2 is a front perspective view illustrating an air conditioner according to an embodiment.
Figure 3:
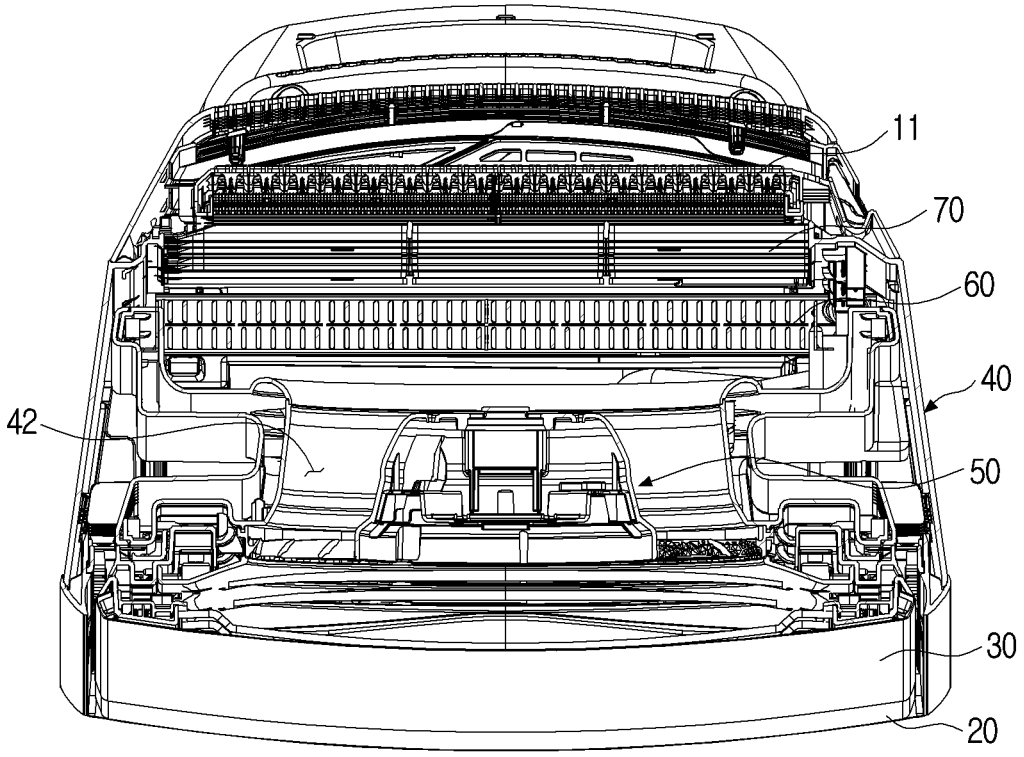
FIG. 3 is a cross-sectional view illustrating the air conditioner of FIG. 2 taken along line I-I.
Figure 4:
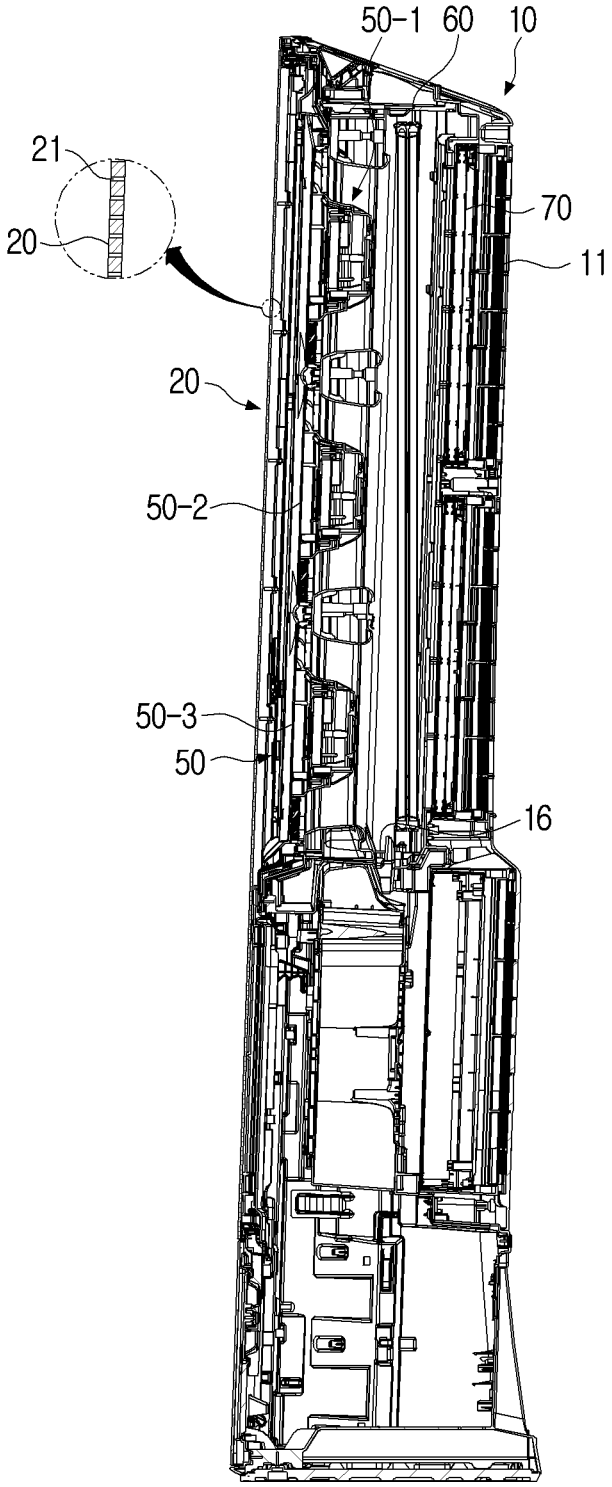
FIG. 4 is a cross-sectional view illustrating the air conditioner of FIG. 2 taken along line II-II.
Figure 5:
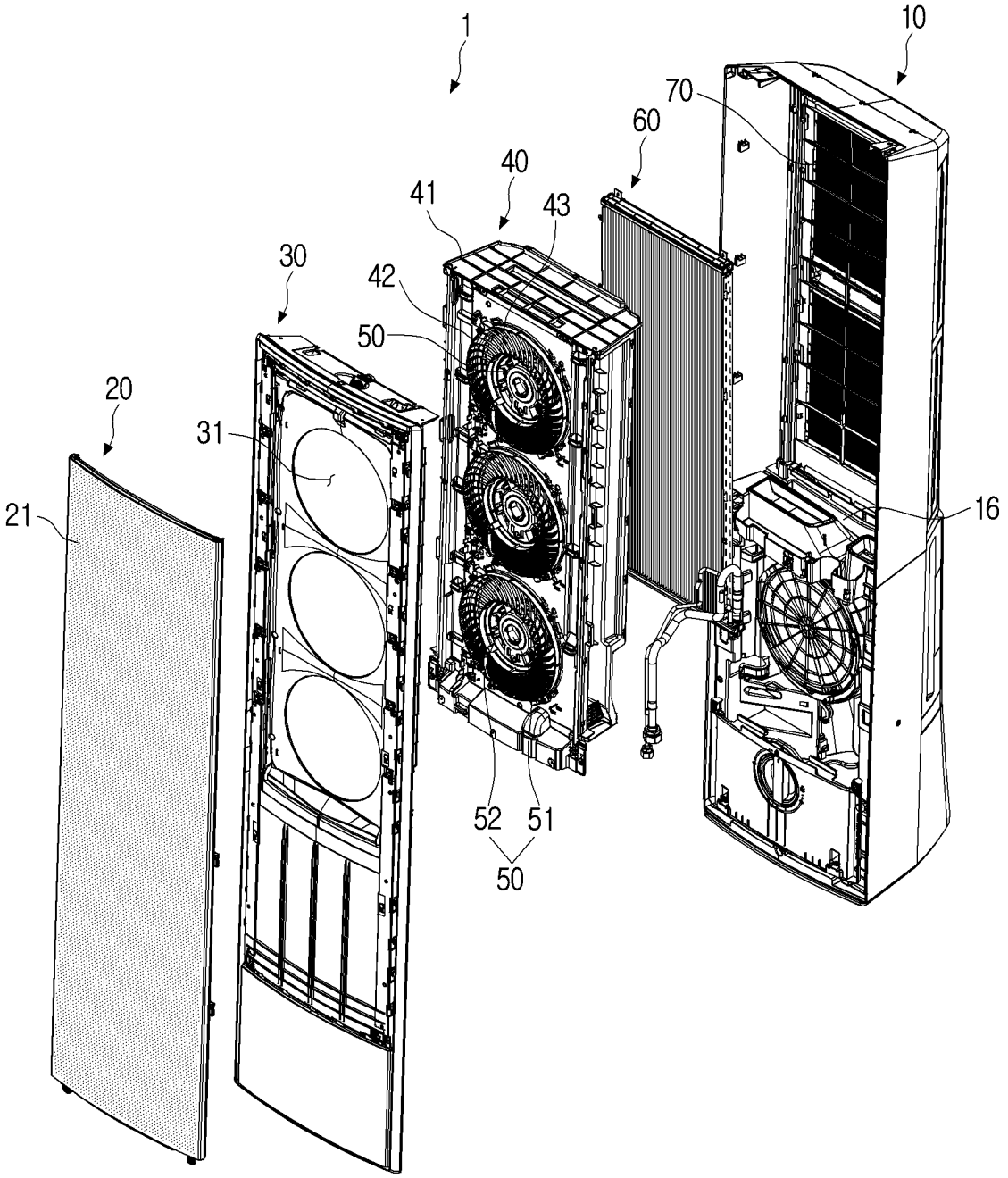
FIG. 5 is an exploded perspective view illustrating an air conditioner according to an embodiment.
Figure 6:
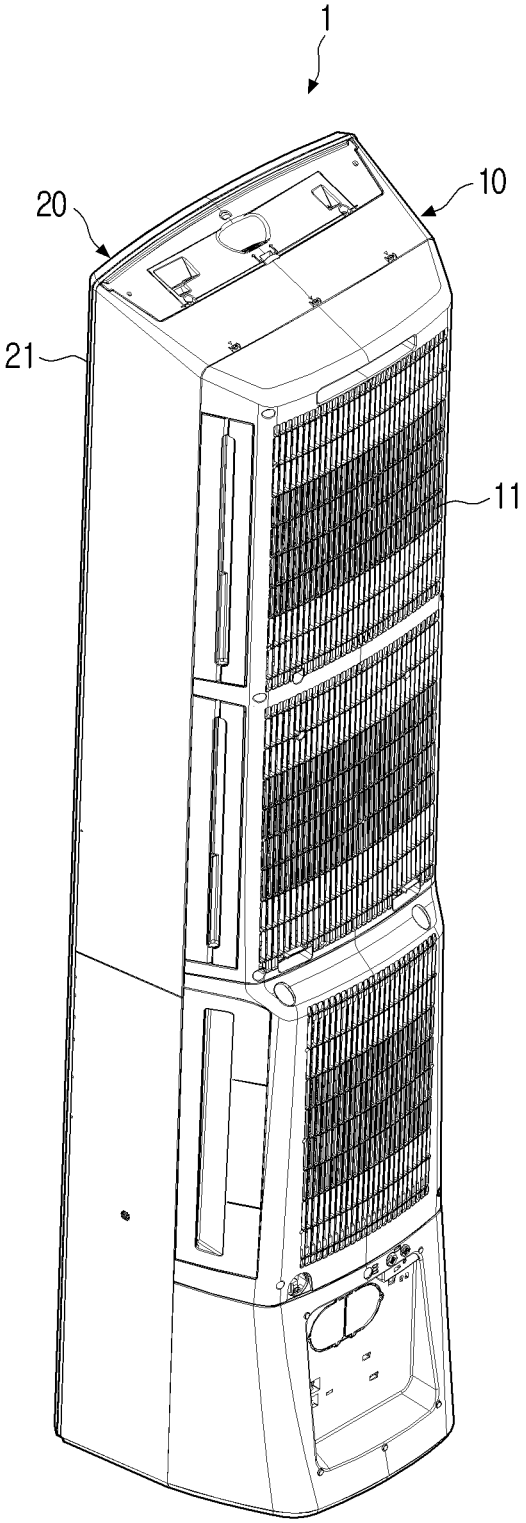
FIG. 6 is a rear perspective view illustrating an air conditioner according to an embodiment.

FIG. 2 is a front perspective view illustrating an air conditioner according to an embodiment. FIG. 3 is a cross-sectional view illustrating the air conditioner of FIG. 2 taken along line I-I. FIG. 4 is a cross-sectional view illustrating the air conditioner of FIG. 2 taken along line II-II. FIG. 5 is an exploded perspective view illustrating an air conditioner according to an embodiment. FIG. 6 is a rear perspective view illustrating an air conditioner according to an embodiment.

Referring to FIGS. 2 to 6, an air conditioner 1 according to an embodiment of the disclosure may include a cabinet 10, a fan assembly 40, and a heat exchanger 60.

The cabinet 10 forms the exterior of the air conditioner 1 and may be formed in a substantially rectangular parallelepiped shape with a long length and a narrow width. For example, the air conditioner 1 may be formed in a stand type.

A front opening 21 may be provided at the front surface of the cabinet 10, and a rear opening 11 may be provided at the rear surface of the cabinet 10. The front opening 21 and the rear opening 11 are formed to allow air to pass therethrough.

The fan assembly 40 and the heat exchanger 60 may be disposed in the inner space of the cabinet 10.

The front surface of the cabinet 10 may be opened. A front panel 30 may be disposed on the open front surface of the cabinet 10. The front panel 30 may be formed in a shape corresponding to the front surface of the cabinet 10. For example, the front panel 30 may be formed in a substantially rectangular shape having a long length and a narrow width.

A plurality of panel holes 31 corresponding to a plurality of fans 50 may be provided in the front panel 30. The plurality of panel holes 31 may be formed in a circular shape. The plurality of panel holes 31 may be vertically provided on the front panel 30.

In the case of the embodiment illustrated in FIGS. 3 and 5, three panel holes 31 are provided in the front panel 30 to correspond to three fans 50. The three panel holes 31 are vertically arranged on the front panel 30 in a straight line.

A micro panel 20 may be disposed on the front side of the front panel 30. The micro panel 20 may be formed to cover the plurality of panel holes 31 of the front panel 30. The micro panel 20 may be formed in a substantially rectangular shape.

The micro panel 20 may be detachably disposed on the front side of the front panel 30.

The micro panel 20 may include a plurality of micro holes 21. The plurality of micro holes 21 may include a large number of micro holes 21 formed to penetrate the micro panel 20 over the entire surface of the micro panel 20. The large number of micro holes 21 may be formed on the entire surface of the micro panel 20 at regular narrow intervals. The large number of micro holes 21 are formed to allow air to pass therethrough. Accordingly, the large number of micro holes 21 may form a front opening of the cabinet 10. Here, the micro hole 21 refers to a fine hole with a small diameter. For example, the micro hole 21 may have a diameter of 3 mm or less.

Accordingly, indoor air may be introduced into the cabinet 10 through the plurality of micro holes 21 of the micro panel 20 and the plurality of panel holes 31 of the front panel 30.

A rear grill 11 may be provided on the rear surface of the cabinet 10. The rear grill 11 may be provided on the rear surface of the cabinet 10 with an area corresponding to the area of the heat exchanger 60. The rear grill 11 may be formed so that indoor air flows into the inside of the cabinet 10 through the rear grill 11. Also, the air inside the cabinet 10 may be discharged to the outside of the cabinet 10 through the rear grill 11. Accordingly, the rear grill 11 may form a rear opening of the cabinet 10.

A filter 70 may be disposed inside the cabinet 10 adjacent to the rear grill 11. The filter 70 is formed to filter the indoor air introduced through the rear grill 11.

The fan assembly 40 is formed to suck indoor air into the cabinet 10 and discharge the sucked air to the outside of the cabinet 10. Accordingly, when the fan assembly 40 operates, the indoor air may form an airflow passing through the cabinet 10.

Also, the fan assembly 40 may be disposed so that the sucked air passes through the heat exchanger 60. For example, the fan assembly 40 may be disposed in front of the heat exchanger 60. In other words, the fan assembly 40 may be disposed between the front panel 30 and the heat exchanger 60.

The fan assembly 40 may include a plurality of fans 50 and a fan support part 41.

The types of the plurality of fans 50 are not limited. The plurality of fans 50 may be configured to generate an airflow capable of introducing air from the outside of the cabinet 10 and discharging the introduced air to the outside of the cabinet 10. For example, any one of a mixed flow fan, a cross fan, a turbo fan, and a sirocco fan may be used as the plurality of fans 50.

The number of the plurality of fans 50 may be two or more. In this embodiment, corresponding to the three panel holes 31 of the front panel 30, three fans 50, that is, a first fan 50-1, a second fan 50-2, and a third fan 50-3 may be included.

The plurality of fans 50 may be vertically disposed inside the cabinet 10, In other words, the plurality of fans 50 may be vertically disposed on the fan support part 41. For example, the first fan 50-1, the second fan 50-2, and the third fan 50-3 may be vertically disposed on the fan support part 41 in a straight line.

The plurality of fans 50 may be disposed in front of the heat exchanger 60 inside the cabinet 10. For example, the first fan 50-1, the second fan 50-2, and the third fan 50-3 may be disposed in front of the heat exchanger 60.

Each of the plurality of fans 50 may include a fan motor 51 and a plurality of blades 52 rotated by the fan motor 51. The fan motor 51 is configured to rotate in both direction.

The fan support part 41 is formed to fix and support the plurality of fans 50. The fan support part 41 is formed to be fixed to the inside of the cabinet 10.

The fan support part 41 may be provided with a plurality of fan holes 42 corresponding to the plurality of fans 50. A grill 43 may be provided at a front end of each of the plurality of fan holes 42. In other words, the fan support part 41 includes a plurality of grills 43.

The plurality of fans 50 are fixed to the plurality of fan holes 42 of the fan support part 41. In other words, the fan 50 is disposed on the rear surface of the grill 43 provided in the fan hole 42. Accordingly, the plurality of grills 43 are positioned in front of the plurality of fans 50, respectively. Therefore, when the plurality of fans 50 operate, air flow through the plurality of fan holes 42 and the plurality of grills 43.

The plurality of grills 43 may be formed in a circular shape to correspond to the plurality of panel holes 31 of the front panel 30. Accordingly, when the fan assembly 40 and the front panel 30 are coupled to each other, the plurality of grills 43 of the fan support part 41 and the plurality of panel holes 31 of the front panel 30 communicate with each other.

The heat exchanger 60 may be provided inside the cabinet 10. The heat exchanger 60 may be disposed in an air flow passage formed inside the cabinet 10. Accordingly, when the plurality of fans 50 are operated, air may pass through the heat exchanger 60.

For example, the heat exchanger 60 may be provided between the fan assembly 40 and the rear opening 11 of the cabinet 10. In other words, the heat exchanger 60 may be disposed between the fan assembly 40 and the rear grill 11 of the cabinet 10. When the filter 70 is disposed on the rear surface of the cabinet 10, the heat exchanger 60 may be disposed between the fan assembly 40 and the filter 70. In other words, the filter 70 may be disposed between the heat exchanger 60 and the rear grill 11 of the cabinet 10.

The heat exchanger 60 is configured to absorb heat from the air introduced through the rear opening 11. For example, the heat exchanger 60 has a substantially rectangular shape, and may include a plurality of tubes and headers coupled to upper ends and lower ends of the plurality of tubes. However, the type and shape of the heat exchanger 60 is not limited thereto.

The heat exchanger 60 may be formed to have an area corresponding to the plurality of fans 50. In detail, the heat exchanger 60 may be formed to have an area larger than that of the plurality of fans 50. For example, the heat exchanger 60 may be formed to have an area corresponding to the fan support part 41 on which the plurality of fans 50 are disposed. Also, the heat exchanger 60 may be formed to have an area corresponding to the rear grill 11 of the cabinet 10.

A drip tray 16 may be provided below the heat exchanger 60. The drip tray 16 is formed to collect condensed water that is generated on the surface of the heat exchanger 60 during a cooling operation and flows downward along the heat exchanger 60.

The air flow passage communicating the front opening 21 and the rear opening 11 may be formed inside the cabinet 10. In other words, the plurality of micro holes 21 of the micro panel 20, the plurality of panel holes 31 of the front panel 30, the plurality of fan holes 42 of the fan assembly 40, and the rear grill 11 of the cabinet 10 form the air flow passage. The heat exchanger 60 is provided in the air flow passage.

Accordingly, when the plurality of fans 50 rotate, indoor air flows through the air flow passage and passes through the heat exchanger 60.

For example, when the plurality of fans 50 rotate in one direction, indoor air is sucked through the rear grill 11 of the cabinet 10, sequentially passes through the heat exchanger 60, the plurality of fan holes 42 of the fan assembly 40, and the plurality of panel holes 31 of the front panel 30, and then is discharged into the room through the plurality of micro holes 21 of the micro panel 20.

When the plurality of fans 50 rotate in opposite directions, indoor air is sucked through the plurality of micro holes 21 of the micro panel 20, sequentially passes through the plurality of panel holes 31 of the front panel 30, the plurality of fan holes 42 of the fan assembly 40, and the heat exchanger 60, and then is discharged into the room through the rear grill 11 of the cabinet 10.

In another embodiment, a discharge guide 80 may be disposed on the rear surface of the air conditioner 1. The discharge guide 80 may be formed to guide the air discharged from the rear grills 11 of the air conditioner 1 in a downward direction of the air conditioner 1. Hereinafter, the discharge guide 80 will be described in detail with reference to FIG. 7.

Figure 7:
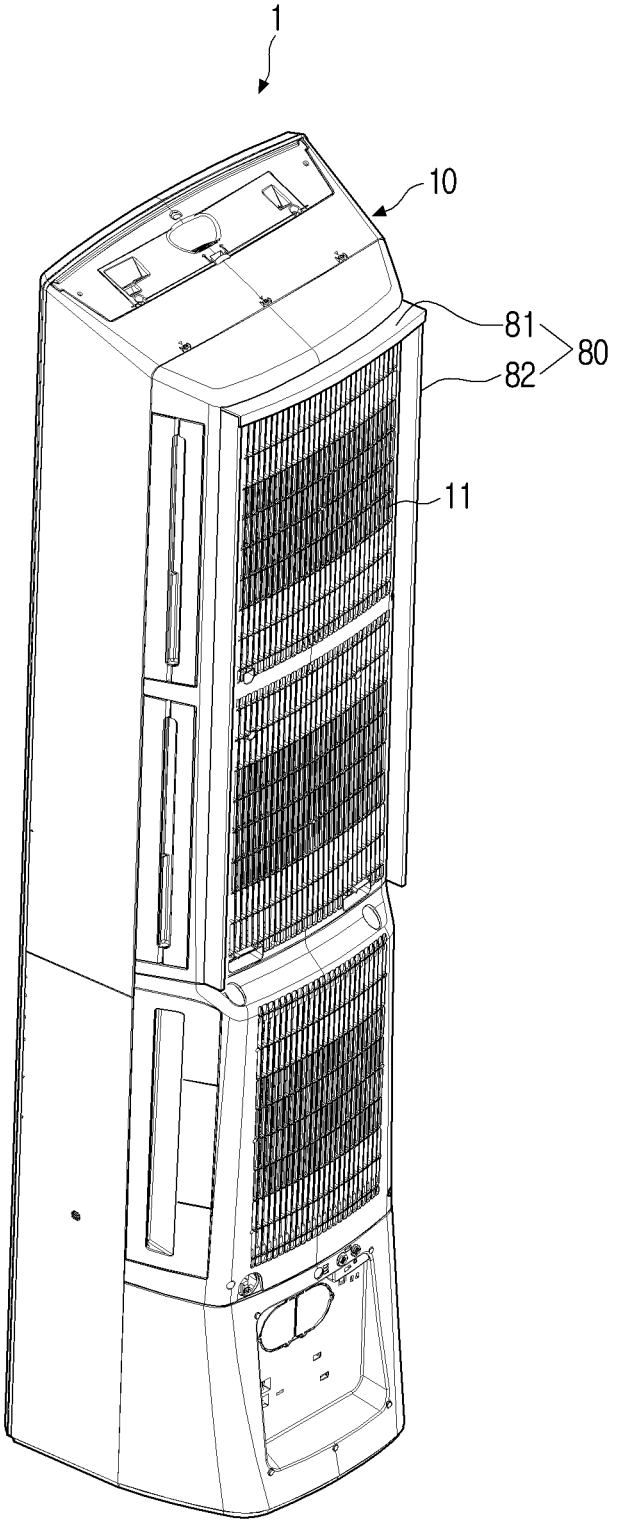
FIG. 7 is a rear perspective view illustrating an air conditioner according to another embodiment.

FIG. 7 is a rear perspective view illustrating an air conditioner according to another embodiment.

Referring to FIG. 7, the discharge guide 80 is disposed on the rear surface of the air conditioner 1. The discharge guide 80 may be disposed on the edge of the rear grill 11.

The discharge guide 80 may include an upper discharge guide 81 disposed on the upper end of the rear grill 11 and side discharge guides 82 disposed on both sides of the rear grill 11.

The upper discharge guide 81 may be formed to block air discharged through the rear grill 11 from moving upward, so that the discharged air moves toward the ground. For example, the upper discharge guide 81 may be formed as a bending member in which one side end of a long strip-shaped flat plate is bent at a substantially right angle as illustrated in FIG. 7. As another example, the upper discharge guide 81 may be formed as a flat plate inclined downward. In other words, the upper discharge guide 81 may be formed by disposing a flat plate having a narrow width and a long length to be inclined downward.

The side discharge guides 82 may be formed to block the air discharged through the rear grill 11 from moving to the front of the air conditioner 1. For example, the side discharge guides 82 may be formed as a flat plate having a narrow width and a long length. The two side discharge guides 82 may be disposed to correspond to both ends of the upper discharge guide 81.

Figure 8:
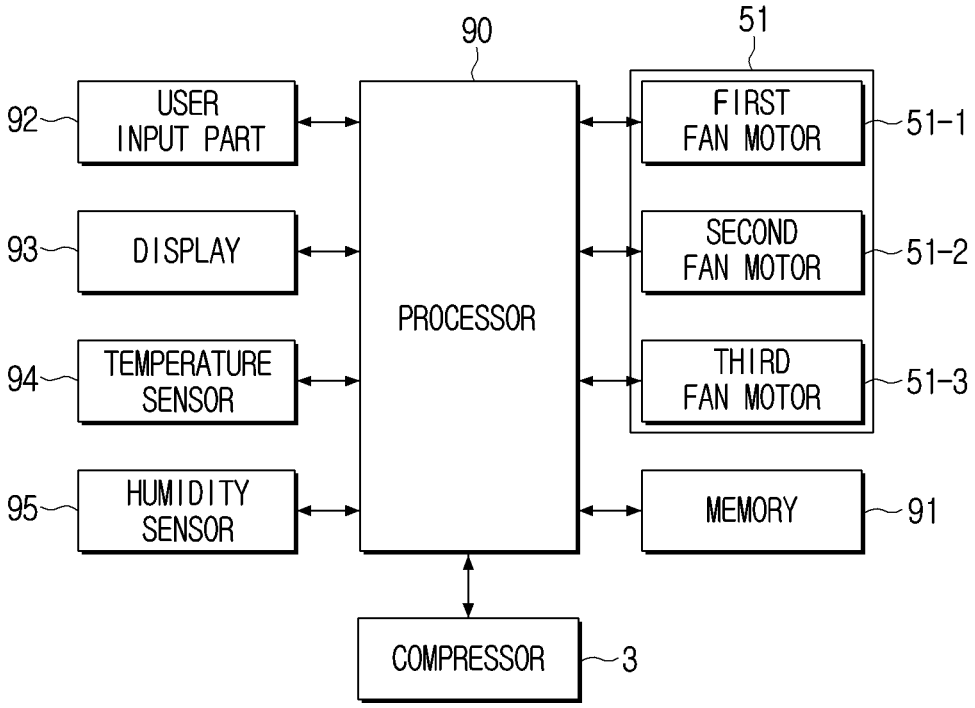
FIG. 8 is a functional block diagram of an air conditioner according to an embodiment.

FIG. 8 is a functional block diagram of an air conditioner according to an embodiment.

Referring to FIG. 8, the air conditioner 1 may include a user input part 92, a display 93, a temperature sensor 94, a humidity sensor 95, a plurality of fan motors 51, a compressor 3, and a processor 90.

The user input part 92 may receive a user input related to the operation of the air conditioner 1 from the user and output an electrical signal corresponding to the received user input to the processor 90.

The user input part 92 may include a plurality of buttons provided in the cabinet 10. For example, the user input part 92 may include a button for setting a target temperature of the room, a button for selecting any one of a cooling mode, a dehumidification mode, and a purifying mode, a button for setting the strength of the wind generated by the plurality of fans 50 (rotation speed of the fans 50), a button for selecting an automatic cleaning operation mode, and the like. The plurality of buttons may be provided on the micro panel 20.

The plurality of buttons may include a push switch and a membrane switch operated by the user's pressing, a touch switch operated by contact with a part of the user's body, or the like.

The user input part 92 may include a receiver configured to receive a radio signal from a remote control. The remote control may include a plurality of buttons having the same function as the plurality of buttons provided on the user input part 92.

The display 93 may be configured to receive information about the operation of the air conditioner 1 and information about the indoor environment from the processor 90, and display the received information. For example, the display 93 may display an indoor target temperature, an indoor measured temperature, an operation mode, a wind strength, and the like. The display 93 may be provided on the micro panel 20. The display 93 may include a liquid crystal display (LCD) panel, a light emitting diode (LED) panel, or the like.

The temperature sensor 94 may be configured to detect the temperature of the room and transmit the detected temperature information to the processor 90 as an electrical signal. For example, the temperature sensor 94 may include a thermistor whose electrical resistance value changes according to temperature.

The temperature sensor 94 may detect the temperature of indoor air that has not passed through the heat exchanger 60. The temperature sensor 94 may be disposed adjacent to the rear grill 11 of the cabinet 10.

The humidity sensor 95 may be configured to detect indoor humidity and transmit the detected humidity information to the processor 90 as an electrical signal. The humidity sensor 95 may detect the humidity of the indoor air that has not passed through the heat exchanger 60. The humidity sensor 95 may be disposed adjacent to the rear grill 11 of the cabinet 10.

The plurality of fan motors 51 may be configured to rotate the plurality of fans 50 under the control of the processor 90. The plurality of fan motors 51 may adjust the rotation speed of the plurality of fans 50 according to the control of the processor 90. The fan motor 51 is configured to rotate the fan 50 at an arbitrary rotation speed within the range of the maximum rotation speed and the minimum rotation speed.

The fans 50 rotated by the fan motors 51 may generate a flow of air (airflow) passing through the heat exchanger 60.

In detail, when the plurality of fans 50 rotate in one direction, indoor air may be sucked through the rear grill 11, and the sucked air may pass through the heat exchanger 60 to exchange heat with the heat exchanger 60. The heat-exchanged air may be discharged to the front of the air conditioner 1 through the plurality of micro holes 21 of the micro panel 20.

When the plurality of fans 50 rotate in opposite directions, indoor air is sucked through the plurality of micro holes 21 of the micro panel 20, and the sucked air passes through the heat exchanger 60. The heat-exchanged air may be discharged to the rear of the air conditioner 1 through the rear grill 11. When the sucked air passes through the heat exchanger 60, the condensed water formed on the surface of the heat exchanger 60 may be dried.

In this embodiment, the plurality of fan motors 51 may include a first fan motor 51-1 configured to rotate the first fan 50-1, a second fan motor 51-2 configured to rotate the second fan 50-2, and a third fan motor 51-3 configured to rotate the third fan 50-3. The first fan motor 51-1, the second fan motor 51-2, and the third fan motor 51-3 may each independently rotate the first fan 50-1, the second fan 50-2, and the third fan 50-3.

The compressor 3 operates under the control of the processor 90, and allows refrigerant to circulate along the refrigerant circuit. In detail, the compressor 3 may be configured to compress a gaseous refrigerant and discharge a high-temperature/high-pressure gaseous refrigerant. The refrigerant discharged from the compressor 3 may circulate through the outdoor heat exchanger 4, the expansion valve 5, and the indoor heat exchanger 60, may discharge heat in the outdoor heat exchanger 4, and may absorb heat in the indoor heat exchanger 60.

As described above, the compressor 3 is disposed in the outdoor unit 2, and the compressor 3 is physically located apart from the processor 90 of the indoor unit 1. Accordingly, the compressor 3 may be configured to communicate with the processor 90.

The processor 90 may include a control circuit, and may be electrically connected with the user input part 92, the display 93, the temperature sensor 94, the humidity sensor 95, the plurality of fan motors 51, and the compressor 3. The processor 90 may control the plurality of fan motors 51 and the compressor 3 based on signals input from the user input part 92, the display 93, the temperature sensor 94, and the humidity sensor 95.

The processor 90 may include a memory 91 for storing programs and/or data for generating control signals.

The processor 90 may process the user input information received through the user input part 92, the indoor temperature information detected by the temperature sensor 94, and the indoor humidity information detected by the humidity sensor 95 based on the program and data stored in the memory 91.

In addition, the processor 90 may output a control signal for controlling the plurality of fan motors 51 and the compressor 3 based on the program and data stored in the memory 91.

The processor 90 may include an arithmetic circuit, a memory circuit, and a control circuit. The processor 90 may include at least one chip. Also, the processor 90 may include at least one core.

The memory 91 may store a program and/or data for processing the user input information, the indoor temperature information, and the indoor humidity information. Also, the memory 91 may store a program and/or data for controlling the plurality of fan motors 51 and the compressor 3.

The memory 91 may include a volatile memory such as a static random access memory (S-RAM), a dynamic random access memory (D-RAM), and the like, and a non-volatile memory such as a read only memory (ROM), an erasable programmable read only memory (EPROM), a flash memory, and the like.

Accordingly, the processor 90 configured as described above may control the operation of the air conditioner 1.

For example, the processor 90 may control the air conditioner 1 to operate in any one of a cooling operation mode, a dehumidification operation mode, and a purifying operation mode based on the user input.

The processor 90 may output a mode control signal for controlling the compressor 3 and the plurality of fan motors 51 according to the operation mode selected by the user input.

When the cooling operation mode is selected, the processor 90 may perform the cooling operation based on the target temperature and the room temperature. During the cooling operation, the processor 90 may operate the compressor 3 and the plurality of fan motors 51. The processor 90 may output a cooling control signal for operating the compressor 3 and the fan motors 51 based on the target temperature set by the user input and the outside temperature detected by the temperature sensor 94.

When the cooling operation mode is selected, the processor 90 may control the rotational speeds of the plurality of fans 50 differently.

For example, when the cooling operation mode is selected, the processor 90 may control the plurality of fans 50 so that the rotation speed of the fan 50-1 located at the top of the plurality of fans 50 is the fastest and the rotation speeds of the remaining plurality of fans 50 located thereunder are sequentially slowed down.

In detail, in the cooling operation mode, the processor 90 may control the plurality of fans 50 so that the rotation speed of the first fan 50-1 located at the top is the fastest, the rotation speed of the second fan 50-2 located below the first fan 50-1 is slower than the rotation speed of the first fan 50-1, and the rotation speed of the third fan 50-3 located below the second fan 50-2, that is, located at the bottom is slower than the rotation speed of the second fan 50-2. In this case, the first fan 50-1 may rotate the fastest, and the third fan 50-3 may rotate the slowest.

In addition, when the cooling operation mode is selected, the processor 90 may rotate the fan 50-1 located at the top of the plurality of fans 50 at the maximum rotation speed. The remaining plurality of fans 50 located thereunder may be controlled by the processor 90 to rotate at a rotation speed that is sequentially lowered.

In detail, in the cooling operation mode, the processor 90 may rotate the first fan 50-1 located at the top at the maximum rotation speed. At this time, the processor 90 may rotate the second fan 50-2 located below the first fan 50-1 below the maximum rotation speed, and may rotate the third fan 50-3 located below the second fan 50-2, that is, located at the bottom at a rotation speed slower than the rotation speed of the second fan 50-2.

When a cooling operation termination command is input through the user input part 92, the processor 90 may perform an automatic cleaning operation. The automatic cleaning operation refers to an operation of drying the inside of the cabinet 10 by rotating the plurality of fans 50 to remove condensed water existing on the surface of the heat exchanger 60 and inside the cabinet 10.

During the automatic cleaning operation, the processor 90 may stop the compressor 3 and operate the plurality of fan motors 51.

During the cooling operation, the refrigerant flows along the heat exchanger 60, and the air sucked through the rear grill 11 comes into contact with the heat exchanger 60 to exchange heat with the refrigerant. When the refrigerant exchanges heat the sucked air, moisture may be condensed on the surface of the heat exchanger 60. The moisture condensed on the surface of the heat exchanger 60 may form condensed water. Some of the condensed moisture may move downward along the surface of the heat exchanger 60 and be collected in the drip tray 16.

When the plurality of fans 50 are stopped immediately after the cooling operation is finished, moisture condensed on the surface of the heat exchanger 60 and moisture collected in the drip tray 16 may not be removed. When moisture exists inside the cabinet 10 including the heat exchanger 60, mold and various microorganisms may grow.

To prevent this, the air conditioner 1 may be configured to dry the heat exchanger 60 and the inside of the cabinet 10 by rotating the plurality of fans 50 after the cooling operation is finished. However, when the plurality of fans 50 are rotated to dry the condensed water inside the cabinet 10, substances causing an unpleasant odor may be emitted together with the air during the drying process.

Accordingly, when the plurality of fans 50 are rotated in the same direction as the cooling operation to dry the heat exchanger 60 and the inside of the cabinet 10, an unpleasant odor is discharged to the front of the air conditioner 1 together with the air. This may cause discomfort to users.

To prevent this, in the disclosure, when the automatic cleaning operation is performed after the cooling operation is completed, the plurality of fans 50 are rotated in the direction opposite to the rotation direction during the cooling operation. In other words, during the automatic cleaning operation, the processor 90 controls the plurality of fan motors 51 to rotate in the direction opposite to the rotation direction during the cooling operation.

When the plurality of fans 50 rotate in the opposite direction, indoor air is sucked into the front opening 21 of the cabinet 10, passes through the heat exchanger 60 disposed inside the cabinet 10, and then is discharged to the outside through the rear opening 11 of the cabinet 10.

In detail, when the plurality of fan motors 51 rotate in the opposite direction, indoor air flows into the plurality of micro holes 21 of the micro panel 20 disposed on the front surface of the cabinet 10, sequentially passes through the plurality of panel holes 31 of the front panel 30 disposed inside the cabinet 10, the plurality of fan holes 42 of the fan assembly 40, and the heat exchanger 60, and then is discharged to the rear of the air conditioner 1 through the rear grill 11 provided on the rear surface of the cabinet 10.

When the air conditioner 1 operates in the dehumidification operation mode, the processor 90 may control the compressor 3 and the plurality of fans 50 based on the humidity input by the user to adjust the indoor humidity. When the air conditioner 1 operates in the dehumidification operation mode, the compressor 3 operates so that condensed water may be generated on the surface of the heat exchanger 60. Accordingly, when terminating the dehumidification operation, the processor 90 may perform the automatic cleaning operation.

When the air conditioner 1 operates in the purifying operation mode, the processor 90 may operate the plurality of fans 50 to allow indoor air to pass through the filter 70 disposed inside of the cabinet 10, thereby purifying the indoor air. When the air conditioner 1 operates in the purifying operation mode, the compressor 3 does not operate so that condensed water is not generated on the surface of the heat exchanger 60. Accordingly, upon terminating the purifying operation, the processor 90 does not perform the automatic cleaning operation.

Hereinafter, the operation of the air conditioner 1 according to an embodiment of the disclosure having the above-described structure will be described with reference to FIGS. 9 and 10.

Figure 9:
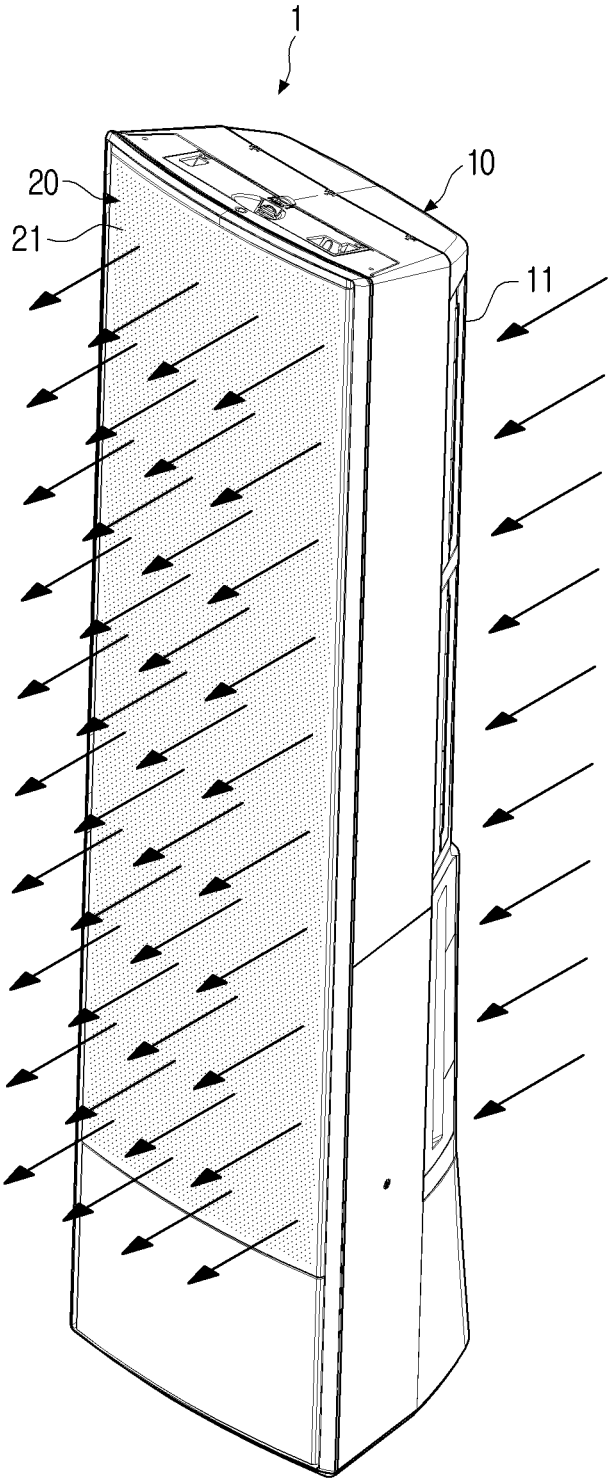
FIG. 9 is a perspective view illustrating a wind direction when an air conditioner according to an embodiment performs a cooling operation.

FIG. 9 is a perspective view illustrating a wind direction when an air conditioner according to an embodiment performs a cooling operation. FIG. 10 is a perspective view illustrating a wind direction when an air conditioner according to an embodiment performs an automatic cleaning operation.

When the cooling operation mode is selected by the user, the processor 90 of the air conditioner 1 performs the cooling operation based on the target temperature and the indoor temperature. When performing the cooling operation, the processor 90 operates the compressor 3 and the plurality of fan motors 51.

When the plurality of fan motors 51 operate in the cooling operation mode, as illustrated in FIG. 9, indoor air is introduced through the rear opening 11 of the air conditioner 1, passes through the heat exchanger 60 disposed inside the air conditioner 1, and then is discharged toward the front of the air conditioner 1 through the front opening 21 of the air conditioner 1.

In detail, when the plurality of fans 50 rotate in one direction, indoor air is introduced into the inside of the cabinet 10 through the rear grill 11 of the cabinet 10. The air introduced through the rear grill 11 of the cabinet 10 passes through the heat exchanger 60 and exchanges heat with the refrigerant of the heat exchanger 60.

The air cooled by the heat exchanger 60 is discharged to the front of the cabinet 10 through the plurality of micro holes 21 of the micro panel 20 disposed on the front surface of the cabinet 10 by the plurality of fans 50 of the fan assembly 40. In other words, the air that has passed through the heat exchanger 60 passes through the plurality of fan holes 42 of the fan assembly 40 and the plurality of panel holes 31 of the front panel 30, and then is discharged to the front of the air conditioner 1 through the plurality of micro holes 21 of the micro panel 20.

When the user inputs a cooling operation termination command through the user input part 92, the processor 90 performs the automatic cleaning operation to dry the heat exchanger 60 and the inside of the cabinet 10.

In detail, the processor 90 stops the compressor 3 and rotates the plurality of fans 50 in the opposite direction.

Figure 10:
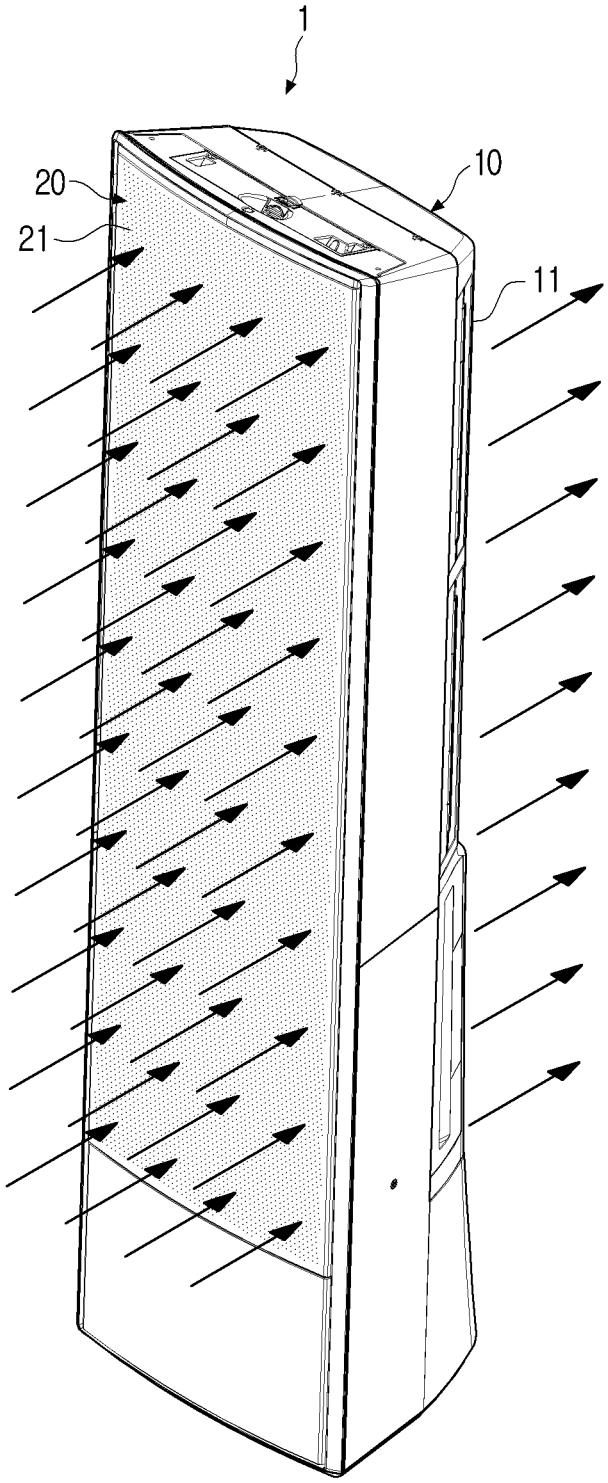
FIG. 10 is a perspective view illustrating a wind direction when an air conditioner according to an embodiment performs an automatic cleaning operation.

When the plurality of fans rotate in the opposite direction, as illustrated in FIG. 10, indoor air is sucked into the front opening 21 of the cabinet 10, passes through the heat exchanger 60 disposed inside the cabinet 10, and then is discharged through the rear opening 11 of the cabinet 10.

In detail, when the plurality of fan motors 51 rotate in the opposite direction, indoor air is introduced into the plurality of micro holes 21 of the micro panel 20 disposed on the front surface of the cabinet 10, passes through the plurality of panel holes 31 of the front panel 30 disposed inside the cabinet 10, the plurality of fan holes 42 of the fan assembly 40, and the heat exchanger 60 in sequence, and then is discharged to the rear of the air conditioner 1 through the rear grill 11 provided in the rear surface of the cabinet 10.

In the air conditioner 1 according to an embodiment of the disclosure having the structure as described above, the air containing an unpleasant odor that has passed through the heat exchanger 60 and the inside of the cabinet 10 is discharged to the rear of the air conditioner 1. Accordingly, unlike the case in which the air is discharged to the front of the air conditioner 1, the user may not feel the unpleasant odor directly when the cooling operation of the air conditioner 1 is finished.

Hereinafter, a method of controlling an air conditioner according to an embodiment of the disclosure will be described with reference to FIG. 11.

Figure 11:
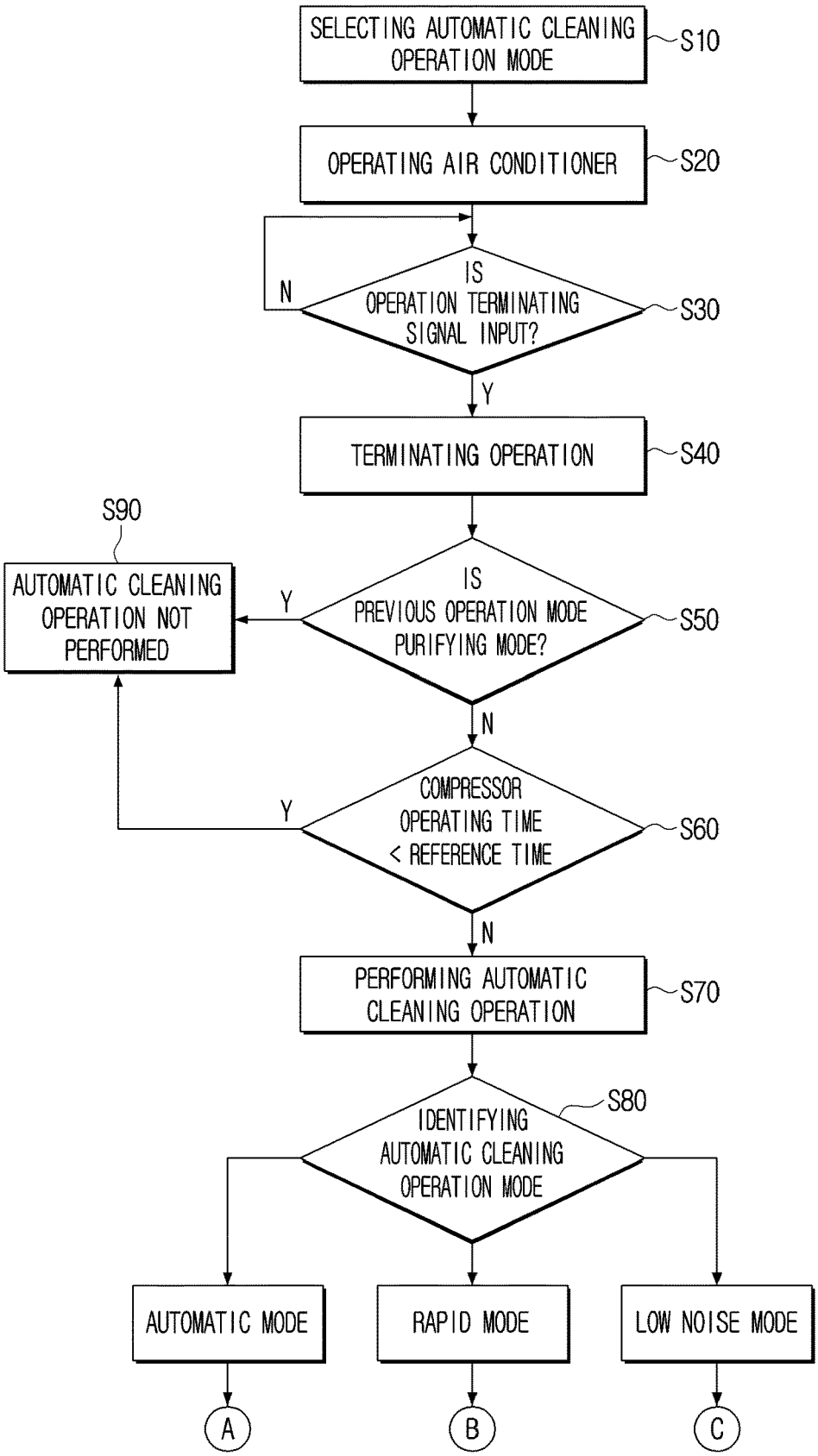
FIG. 11 is a flowchart illustrating a method of controlling an air conditioner according to an embodiment.

FIG. 11 is a flowchart illustrating a method of controlling an air conditioner according to an embodiment.

Referring to FIG. 11, the user selects an automatic cleaning operation mode of the air conditioner 1 (S10). For example, the user may select the automatic cleaning operation mode through the user input part 92.

The automatic cleaning operation mode may include an automatic mode, a rapid mode, and a low noise mode.

In the automatic mode, the processor 90 may automatically identify the time for performing the automatic cleaning operation based on the indoor humidity. In detail, the processor 90 may identify the time for performing the automatic cleaning operation by using humidity information transmitted from the humidity sensor 95. The automatic mode will be described in detail below.

The rapid mode is a mode for quickly drying the inside of the air conditioner 1, and the air conditioner 1 performs the automatic cleaning operation with maximum wind for a predetermined time. In detail, in the rapid mode, the processor 90 may rotate the plurality of fans 50 at the maximum rotation speed for a predetermined time.

The low noise mode is a mode for minimizing noise generated during the automatic cleaning operation, and the air conditioner 1 performs the automatic cleaning operation with the minimum wind for a predetermined time. In detail, in the low noise mode, the processor 90 may rotate the plurality of fans 50 at the minimum rotation speed for a predetermined time. In the case of the low noise mode, the rotation time of the plurality of fans 50 is longer than that in the rapid mode.

Accordingly, the user may select one of the automatic mode, the rapid mode, and the low noise mode as needed.

When the selection of the automatic cleaning operation mode is completed, the user operates the air conditioner 1 (S20).

For example, the user may select a cooling operation through the user input part 92. Then, the processor 90 of the air conditioner 1 may perform the cooling operation in response to a user input for cooling the room.

During the cooling operation, the processor 90 may operate the compressor 3 and the plurality of fan motors 51 based on the target temperature input by the user and the indoor temperature detected by the temperature sensor 94.

For example, the processor 90 may operate the compressor 3 so that the refrigerant circulates through the heat exchanger 60 and absorbs heat from the indoor air, and may operate the plurality of fan motors 51 to discharge the cooled air around the heat exchanger 60 to the room.

In addition, during the cooling operation, the processor 90 may control the plurality of fan motors 51 so that the fan 50 located at the top of the plurality of fans 50 has the fastest rotation speed and the remaining plurality of fans 50 located thereunder have rotation speeds that are sequentially lowered.

For example, during the cooling operation, the processor 90 may control the plurality of fan motors 51 so that the fan located at the top of the plurality of fans 50, that is, the first fan 50-1, rotates at the maximum rotation speed, and the remaining plurality of fans 50 located thereunder, that is, the second fan 50-2 and the third fan 50-3 rotate at rotation speeds that are sequentially decreased. At this time, the second fan 50-2 and the third fan 50-3 do not rotate at the maximum rotation speed.

During the cooling operation, the heat exchanger 60 is cooled by evaporation of the refrigerant, and air sucked by the plurality of fans 50 may pass through the heat exchanger 60. The air is cooled while passing through the heat exchanger 60, and moisture contained in the air may be condensed on the surface of the heat exchanger 60. In addition, the moisture contained in the air may be condensed on the grills 43 of the fan support part 41 as well as the heat exchanger 60.

The air conditioner 1 identifies whether a user input for terminating the operation is input (S30).

The user may input the user input for terminating the operation of the air conditioner 1 through the user input part 92 or the remote control. When the user input for terminating the operation is input, the user input part 92 or the remote control may output an operation terminating signal.

For example, the processor 90 may receive the user input for terminating the cooling operation through the user input part 92. In other words, the processor 90 may receive the operation terminating signal from the user input part 92.

When the user input for terminating the cooling operation is not input, the processor 90 continues the cooling operation.

When the user input for terminating the operation is input, the processor 90 terminates the operation of the air conditioner 1 (S40).

For example, when the operation terminating signal is input, the processor 90 stops the compressor 3 and the plurality of fan motors 51.

In detail, the processor 90 identifies whether the compressor 3 is operating or not. When the compressor 3 is operating, the processor 90 stops the compressor 3. On the other hand, when the compressor 3 is stopped, the processor 90 causes the compressor 3 to maintain the stopped state.

Next, the processor 90 identifies whether the previous operation mode is the purifying operation mode (S50). When the previous operation mode is the purifying operation mode, the processor 90 does not perform the automatic cleaning operation (S90).

When the previous operation mode is not the purifying operation mode, that is, when the previous operation mode is the cooling operation or the dehumidifying operation, the processor 90 identifies whether the operating time of the compressor 3 is less than a reference time (S60).

For example, the processor 90 may identify the operating time of the compressor 3 using a timer during the cooling operation. In addition, the processor 90 may compare the operating time of the compressor 3 with the reference time.

The reference time may be set experimentally or empirically. For example, the reference time may be set based on a time for which moisture is condensed on the surface of the heat exchanger 60 by the operation of the compressor 3. For example, the reference time may be set to 20 seconds.

When the operating time of the compressor 3 is less than the reference time, the processor 90 does not perform the automatic cleaning operation (S90).

When the previous operation mode is the cooling operation and the dehumidifying operation, and the operating time of the compressor 3 is equal to or longer than the reference time, the processor 90 performs the automatic cleaning operation (S70).

When performing the automatic cleaning operation, the processor 90 rotates the plurality of fans 50 in the opposite direction. In detail, the processor 90 rotates the plurality of fan motors 51 in a direction opposite to the direction in which the processor 90 rotates the plurality of fan motors 51 during the cooling operation.

When the plurality of fans 50 rotate in the opposite direction, indoor air may be sucked in through the front opening 21 of the cabinet 10 and discharged to the rear of the air conditioner 1 through the rear opening 11.

In detail, when the plurality of fans 50 rotate in the opposite direction, indoor air is sucked through the plurality of micro holes 21 of the micro panel 20 and introduced into the inside of the cabinet 10. The sucked air may pass through the heat exchanger 60 via the plurality of panel holes 31 of the front panel 30 and the plurality of fan holes 42 of the fan assembly 40. The air passing through the heat exchanger 60 may be discharged to the rear of the cabinet 10 through the rear grill 11.

As described above, indoor air may pass through the heat exchanger 60. While the air passes through the heat exchanger 60, the air may dry moisture condensed on the surface of the heat exchanger 60. Also, when the air passes through the plurality of grills 43 of the fan assembly 40, moisture attached to the plurality of grills may be dried.

The processor 90 identifies the selected automatic cleaning operation mode before performing the automatic cleaning operation (S80). In detail, the processor 90 identifies which mode among the automatic mode, the rapid mode, and the low noise mode is set as the automatic cleaning operation mode.

Figure 12:
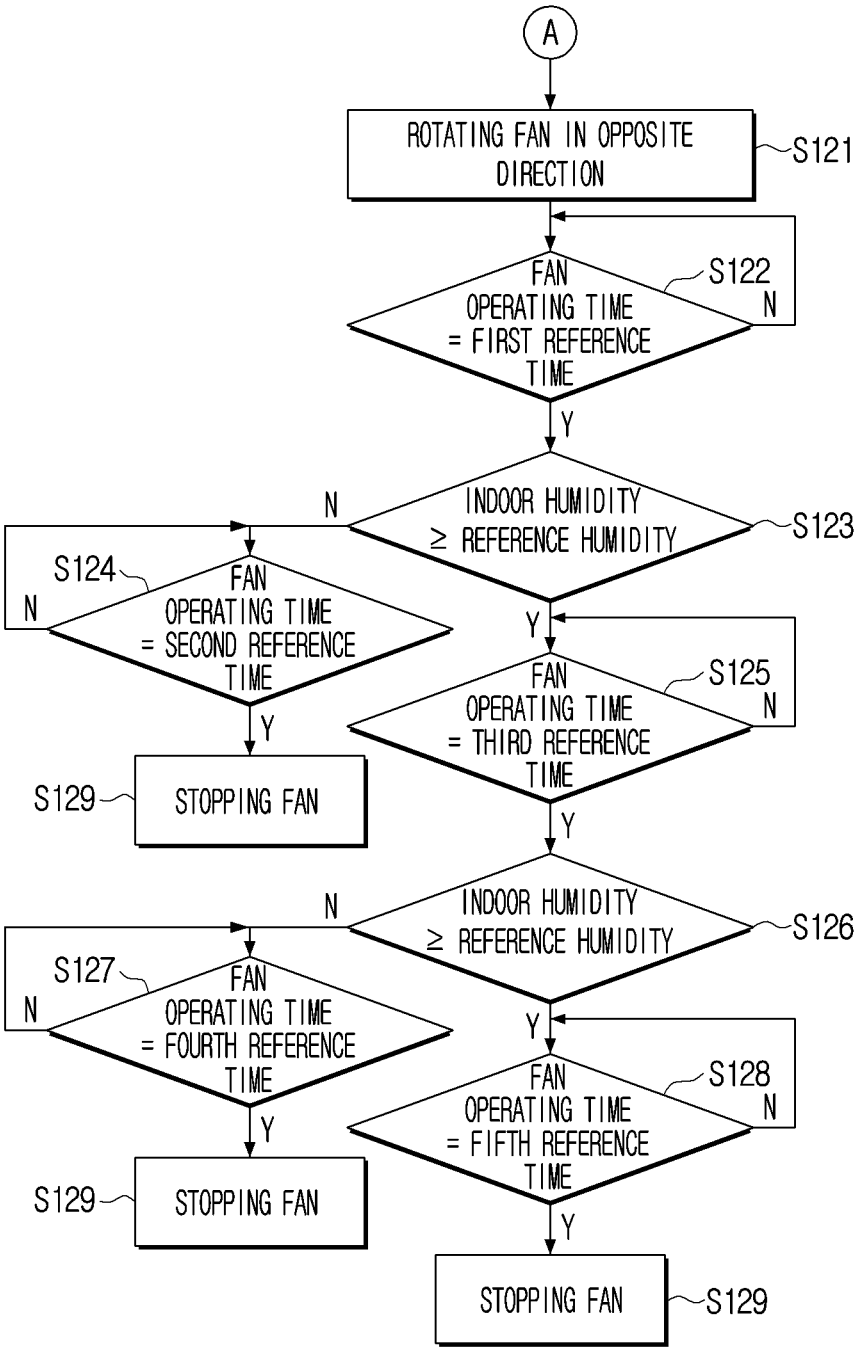
FIG. 12 is a flowchart illustrating an automatic cleaning operation in an automatic mode of an air conditioner according to an embodiment.

When the automatic cleaning operation mode is set to the automatic mode, the processor 90 performs the automatic cleaning operation in the automatic mode as illustrated in FIG. 12.

Figure 13:
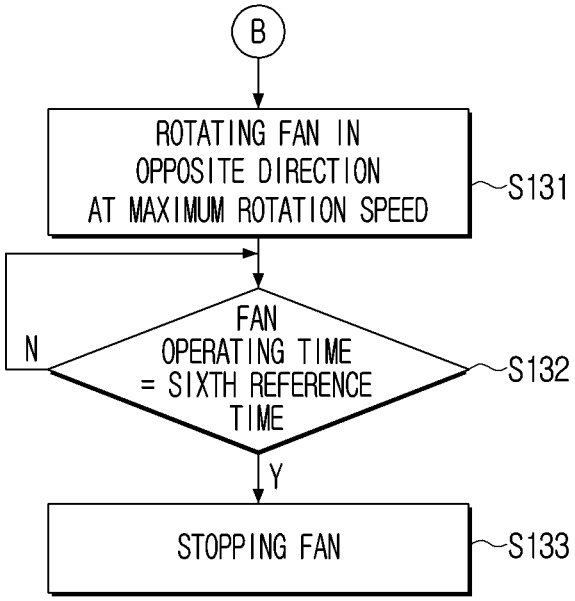
FIG. 13 is a flowchart illustrating an automatic cleaning operation in a rapid mode of an air conditioner according to an embodiment.

When the automatic cleaning operation mode is set to the rapid mode, the processor 90 performs the automatic cleaning operation in the rapid mode as illustrated in FIG. 13.

Figure 14:
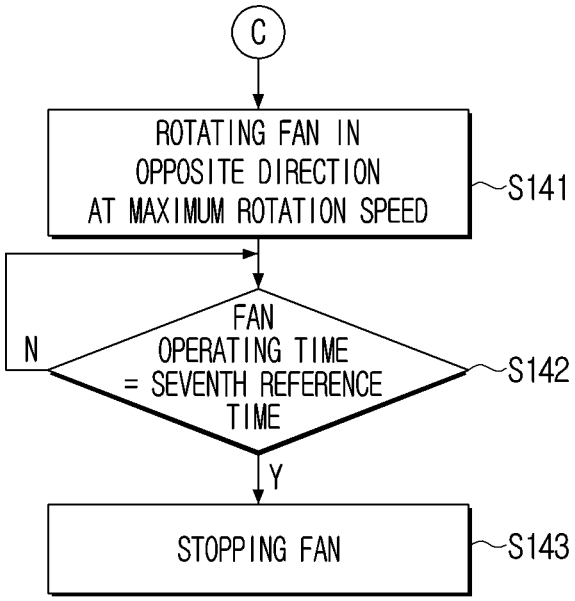
FIG. 14 is a flowchart illustrating an automatic cleaning operation in a low noise mode of an air conditioner according to an embodiment.

When the automatic cleaning operation mode is set to the low noise mode, the processor 90 performs the automatic cleaning operation in the low noise mode as illustrated in FIG. 14.

Hereinafter, a case in which the automatic cleaning operation mode is the automatic mode will be described in detail with reference to FIG. 12.

FIG. 12 is a flowchart illustrating an automatic cleaning operation in an automatic mode of an air conditioner according to an embodiment.

Referring to FIG. 12, when the automatic mode is selected, the processor 90 rotates the plurality of fans 50, that is, the plurality of fan motors 51 in the opposite direction (S121). Then, the indoor air is sucked through the plurality of micro holes 21 of the micro panel 20 and introduced into the cabinet 10. The sucked air may pass through the heat exchanger 60 via the plurality of panel holes 31 of the front panel 30 and the plurality of fan holes 42 of the fan assembly 40. The air passing through the heat exchanger 60 may be discharged to the rear of the cabinet 10 through the rear grill 11.

At this time, the processor 90 may make the rotation speed of the fan 50-3 located at the bottom of the plurality of fans 50 the fastest, and may make the rotation speeds of the remaining plurality of fans 50 located thereover sequentially slowed. In other words, the processor 90 may control the third fan 50-3 and the second fan 50-2 so that the rotation speed of the third fan 50-3 is the fastest and the rotation speed of the second fan 50-2 is slower than the rotation speed of the third fan 50-3. In addition, the processor 90 may control the rotation speed of the first fan 50-1 to be slower than the rotation speed of the second fan 50-2.

For example, when the automatic cleaning operation is performed, the fan 50-3 located at the bottom of the plurality of fans 50 is rotated at the maximum rotation speed, and the remaining plurality of fans 50 located thereover are rotated at rotation speeds that are sequentially slowed. In other words, the rotation speed of the third fan 50-3 may be set to the maximum rotation speed, and the rotation speed of the second fan 50-2 may be set to be slower than the rotation speed of the third fan 50-3. In addition, the rotation speed of the first fan 50-1 may be set to be slower than the rotation speed of the second fan 50-2.

When the third fan 50-3 located at the bottom is rotated at the maximum rotation speed as described above, the moisture collected in the drip tray 16 provided under the heat exchanger 60 may be quickly dried.

Thereafter, the processor 90 identifies whether a first reference time has elapsed after starting the automatic cleaning operation. In detail, the processor 90 identifies whether the first reference time has elapsed after rotating the plurality of fan motors 51 in the opposite direction. In other words, the processor 90 identifies whether the fan operating time has reached the first reference time (S122). For example, the first reference time may be set to 5 minutes.

When the fan operating time reaches the first reference time, the processor 90 identifies whether the humidity of the indoor space (hereinafter, indoor humidity) is equal to or greater than a reference humidity (S123). For example, the reference humidity may be set to 60%.

When the indoor humidity is less than the reference humidity, the processor 90 identifies whether the fan operating time has reached a second reference time (S124). For example, the second reference time may be set to 10 minutes.

When the fan operating time reaches the second reference time, the processor 90 stops the plurality of fans 50 (S129). In other words, when the indoor humidity is less than the reference humidity, the processor 90 further operates the plurality of fan motors 51 for a predetermined time (e.g., 5 minutes), and then stops the plurality of fan motors 51. In this case, the automatic cleaning operation time is 10 minutes.

When the fan operating time reaches the first reference time, but the indoor humidity is equal to or higher than the reference humidity, the processor 90 continuously operates the plurality of fan motors 51 and identifies whether the fan operating time has reached a third reference time (S125). For example, the third reference time may be set to 15 minutes.

When the fan operating time reaches the third reference time, the processor 90 identifies whether the indoor humidity is equal to or greater than the reference humidity (S126).

When the indoor humidity is less than the reference humidity, the processor 90 continuously operates the plurality of fan motors 51 and identifies whether the fan operating time has reached a fourth reference time (S127). For example, the fourth reference time may be set to 20 minutes.

When the fan operating time reaches the fourth reference time, the processor 90 stops the plurality of fans 50 (S129). In other words, when the indoor humidity is less than the reference humidity, the processor 90 further operates the plurality of fan motors 51 for a predetermined time (e.g., 5 minutes), and then stops the plurality of fan motors 51. In this case, the automatic cleaning operation time is 20 minutes.

When the fan operating time reaches the third reference time, but the indoor humidity is equal to or higher than the reference humidity, the processor 90 continuously operates the plurality of fan motors 51 and identifies whether the fan operating time has reached a fifth reference time (S128). For example, the fifth reference time may be set to 35 minutes.

When the fan operating time reaches the fifth reference time, the processor 90 stops the plurality of fans 50 (S129). In other words, when the indoor humidity is equal to or greater than the reference humidity, the processor 90 further operates the plurality of fan motors 51 for a predetermined time (e.g., 20 minutes), and then stops the plurality of fan motors 51. In this case, the automatic cleaning operation time is 35 minutes.

As described above, when the automatic cleaning operation mode is the automatic mode, the processor 90 may adjust the operating time of the plurality of fans 50 based on the humidity of the indoor air. In other words, when the automatic cleaning operation mode is set to the automatic mode, the air conditioner 1 may appropriately perform the automatic cleaning operation based on the indoor humidity.

Hereinafter, a case in which the automatic cleaning operation mode is the rapid mode will be described with reference to FIG. 13.

FIG. 13 is a flowchart illustrating an automatic cleaning operation in a rapid mode of an air conditioner according to an embodiment.

Referring to FIG. 13, when the rapid mode is selected, the processor 90 rotates the plurality of fans 50, that is, the plurality of fan motors 51 in the opposite direction (S131). In this case, the processor 90 may rotate all the plurality of fans 50 at the maximum rotation speed. In other words, the processor 90 may rotate all of the first fan motor 51-1, the second fan motor 51-2, and the third fan motor 51-3 at the maximum rotation speed.

Then, the indoor air is sucked through the plurality of micro holes 21 of the micro panel 20 and introduced into the cabinet 10, and the sucked air passes through the heat exchanger 60 via the plurality of panel holes 31 of the front panel 30 and the plurality of fan holes 42 of the fan assembly 40. The air passing through the heat exchanger 60 may be discharged to the rear of the cabinet 10 through the rear grill 11.

Thereafter, the processor 90 identifies whether a sixth reference time has elapsed after starting the automatic cleaning operation. In detail, the processor 90 identifies whether the sixth reference time has elapsed after rotating the plurality of fan motors 51 at the maximum rotation speed in the opposite direction. In other words, the processor 90 identifies whether the fan operating time has reached the sixth reference time (S132). For example, the sixth reference time may be 20 minutes.

When the fan operating time reaches the sixth reference time, the processor 90 stops the plurality of fan motors 51 (S133).

As described above, when the automatic cleaning operation mode is the rapid mode, all of the plurality of fans 50 generate the maximum wind. Therefore, the plurality of grills 43 of the fan support part 41 and the heat exchanger 60 positioned inside the cabinet 10 may be quickly dried.

Hereinafter, a case in which the automatic cleaning operation mode is the low noise mode will be described with reference to FIG. 14.

FIG. 14 is a flowchart illustrating an automatic cleaning operation in a low noise mode of an air conditioner according to an embodiment.

Referring to FIG. 14, when the low noise mode is selected, the processor 90 rotates the plurality of fans 50, that is, the plurality of fan motors 51 in the opposite direction (S140). In this case, the processor 90 may rotate all of the plurality of fans 50 at the minimum rotation speed. In other words, the processor 90 may rotate all of the first fan motor 51-1, the second fan motor 51-2, and the third fan motor 51-3 at the minimum rotation speed.

Then, the indoor air is sucked through the plurality of micro holes 21 of the micro panel 20 and introduced into the cabinet 10, and the sucked air passes through the heat exchanger 60 via the plurality of panel holes 31 of the front panel 30 and the plurality of fan holes 42 of the fan assembly 40. The air passing through the heat exchanger 60 may be discharged to the rear of the cabinet 10 through the rear grill 11.

Thereafter, the processor 90 identifies whether a seventh reference time has elapsed after starting the automatic cleaning operation. In detail, the processor 90 identifies whether the seventh reference time has elapsed after rotating the plurality of fan motors 51 at the minimum rotation speed in the opposite direction. In other words, the processor 90 identifies whether the fan operating time has reached the seventh reference time (S142). For example, the seventh reference time may be 60 minutes.

When the fan operating time reaches the seventh reference time, the processor 90 stops the plurality of fan motors 51 (S143).

As described above, when the automatic cleaning operation mode is the low noise mode, all of the plurality of fans 50 generate the minimum wind. Therefore, the plurality of grills 43 of the fan support part 41 and the heat exchanger 60 positioned inside the cabinet 10 may be dried with low noise.

As described above, according to the air conditioner and the control method according to an embodiment of the disclosure, the wind containing the smell is blown to the rear of the air conditioner during the automatic cleaning operation for drying the inside of the air conditioner. Accordingly, air containing an unpleasant odor is not discharged toward the user.

In the above, the disclosure has been shown and described with reference to various embodiments. However, it will be understood by those skilled in the art that various changes may be made in form and detail without departing from the spirit and scope of the disclosure as defined by the appended claims and their equivalents.

What is claimed is:

1. An air conditioner comprising:

a cabinet including a front opening formed at a front surface of the cabinet, and a rear opening formed at a rear surface of the cabinet so that the front opening and the rear opening form an air flow passage inside the cabinet;

a heat exchanger provided in the air flow passage inside the cabinet;

a plurality of fans inside the cabinet and configured to guide air to pass through the heat exchanger; and a processor configured to control the plurality of fans so that in a cooling operation mode and a dehumidification operation mode, the plurality of fans are rotated in a first direction so that air is suctioned through the rear opening of the cabinet to flow through the air flow passage and pass through the heat exchanger, and the air is discharged through the front opening to an exterior of the cabinet, and in an automatic cleaning operation mode, the plurality of fans are rotated in a second direction, opposite to the first direction, until the automatic cleaning operation mode is completed, so that air is suctioned through the front opening of the cabinet to flow through the air flow passage and pass through the heat exchanger, and the air is discharged through the rear opening to the exterior of the cabinet, wherein in the automatic cleaning operation mode, the processor controls a rotation speed of a fan located at a bottom of the plurality of fans to be fastest among the plurality of fans, and controls rotation speeds of remaining fans among the plurality of fans located thereover to be sequentially slowed, such that a rotation speed of a fan among the remaining fans is slower than a rotation speed of another fan among the remaining fans located below the fan.

2. The air conditioner of claim 1, wherein the plurality of fans are positioned along a vertical axis inside the cabinet.

3. The air conditioner of claim 1, wherein the plurality of fans are positioned in between the front opening and the heat exchanger.

4. The air conditioner of claim 1, wherein the heat exchanger has an area corresponding to the plurality of fans.

5. The air conditioner of claim 1, wherein during the cooling operation mode, the processor controls a rotation speed of a fan located at a top of the plurality of fans to be fastest among the plurality of fans, and controls rotation speeds of remaining fans among the plurality of fans located thereunder to be sequentially slowed.

6. The air conditioner of claim 5, wherein the processor rotates the fan located at the top of the plurality of fans at a maximum rotation speed during the cooling operation mode.

7. The air conditioner of claim 1, wherein the processor rotates the fan located at the bottom of the plurality of fans at a maximum rotation speed during the automatic cleaning operation mode.

8. The air conditioner of claim 1, wherein the front opening of the cabinet includes a plurality of micro holes.

9. The air conditioner of claim 1, further comprising:

a humidity sensor in the cabinet and configured to transmit humidity information of the air to the processor, wherein the processor is configured to adjust an operating time of the plurality of fans based on the humidity information transmitted from the humidity sensor when performing the automatic cleaning operation mode.

10. The air conditioner of claim 1, wherein the automatic cleaning operation mode includes an automatic mode, a rapid mode, and a low noise mode.

11. A control method of an air conditioner comprising:

operating a compressor so that refrigerant flows through an inside of a heat exchanger;

rotating a plurality of fans in a first direction while the compressor is in operation, so that indoor air is suctioned through a rear opening of a cabinet to flow through an air flow passage and pass through the heat exchanger, and the indoor air is discharged through a front opening of the cabinet to an exterior of the cabinet;

stopping the compressor and the plurality of fans; and rotating the plurality of fans in a second direction, opposite to the first direction, until an automatic cleaning operation mode is completed, to perform the automatic cleaning operation in which the indoor air is suctioned through the front opening of the cabinet to flow through an air flow passage and pass through the heat exchanger, and the indoor air is discharged through the rear opening of the cabinet to an exterior of the cabinet, wherein during rotation of the plurality of fans in the second direction to perform the automatic cleaning operation, a rotation speed of a fan located at a bottom of the plurality of fans is fastest among the plurality of fans, and rotation speeds of remaining fans among the plurality of fans located thereover are sequentially slowed, such that a rotation speed of a fan among the remaining fans is slower than a rotation speed of another fan among the remaining fans located below the fan.

12. The control method of the air conditioner of claim 11, wherein during rotation of the plurality of fans in the second direction to perform the automatic cleaning operation, the fan located at the bottom of the plurality of fans is rotated at a maximum rotation speed.

13. The control method of the air conditioner of claim 11, wherein during rotation of the plurality of fans in the second direction to perform the automatic cleaning operation comprises adjusting an operating time of the plurality of fans based on a humidity of the indoor air.

* * * * *